United States Patent [19]

Hall et al.

[11] Patent Number: 4,507,092

[45] Date of Patent: Mar. 26, 1985

[54] IDLE EXHAUST FOR MARINE PROPULSION SYSTEMS

[75] Inventors: Charles B. Hall, Ingleside; Martin J. Mondek, Wonder Lake, both of Ill.

[73] Assignee: Outboard Marine Corporation, Waukegan, Ill.

[21] Appl. No.: 504,626

[22] Filed: Jun. 15, 1983

[51] Int. Cl.[3] ..... B63H 21/26

[52] U.S. Cl. ..... 440/89; 440/77

[58] Field of Search ..... 440/77, 89, 88

[56] References Cited

U.S. PATENT DOCUMENTS

| | | | |
|---|---|---|---|
| 3,310,022 | 3/1967 | Kollman | 115/17 |
| 3,358,668 | 12/1967 | Post et al. | 440/77 |
| 3,911,852 | 10/1975 | Miller et al. | 115/17 |
| 3,967,446 | 7/1976 | Harralson et al. | 440/89 |
| 4,036,162 | 7/1977 | Maier et al. | 115/17 |
| 4,303,401 | 12/1981 | Sanmi et al. | 440/88 |
| 4,421,490 | 12/1983 | Nakahama | 440/89 |

FOREIGN PATENT DOCUMENTS

| | | | |
|---|---|---|---|
| 26091 | 2/1982 | Japan | 440/77 |

*Primary Examiner*—Trygve M. Blix
*Assistant Examiner*—Thomas J. Brahan
*Attorney, Agent, or Firm*—Michael, Best & Friedrich

[57] ABSTRACT

A marine propulsion device comprising a propulsion unit including an internal combustion engine including an exhaust gas outlet, and a lower unit connected to the engine and including a rotatably supported propeller intended to be at least partially submerged in water, an exhaust gas discharge outlet intended to be submerged in water when the engine is operating at low speed, an exhaust gas duct extending from the engine exhaust gas outlet to the discharge outlet, an exhaust relief outlet communicating with the atmosphere, and an exhaust relief passageway extending from the engine exhaust gas outlet to the exhaust relief outlet.

9 Claims, 2 Drawing Figures

IDLE EXHAUST FOR MARINE PROPULSION SYSTEMS

BACKGROUND OF THE INVENTION

This invention relates generally to marine propulsion devices such as outboard motors and stern drive units and, more particularly, to exhaust gas discharge systems including idle exhaust gas release arrangements.

A properly designed exhaust system provides a means for an internal combustion engine to exhaust or vent combustion carbon products to atmosphere. In many circumstances, outboard motors vent their exhaust gases downwardly through an exhaust housing to a through-the-hub propeller. At high speeds or when the motor is raised up in the water so that the hub is near the surface of the water, exhaust gases can easily pass through the exhaust housing and out through the propeller hub. At idle or slow speed conditions, however, the outboard motor sets lower in the water resulting in an increased back pressure at the propeller hub. This increased back pressure can restrict or prevent the venting or exhaust gases.

Idle exhaust relief systems have accordingly been provided for venting of exhaust gases at idle or slow speed. Such systems have provided for direct contact of an exhaust relief passageway with a wall of water provided for cooling of the exhaust gas duct running to the propeller hub. When the exhaust relief system is in unrestricted communication with this wall of water, the amount of back pressure from the wall of water will vary with boat load conditions, water conditions, and the overall system design of the wall of water. This back pressure caused by the wall of water can significantly reduce the efficiency of an idle exhaust relief system which is in unrestricted communication with the wall of water.

Examples of prior constructions which include exhaust relief systems are Sanmi et al. U.S. Pat. No. 4,303,401, Kollman U.S. Pat. No. 3,310,222 and Maier et al. U.S. Pat. No. 4,036,162. An exhaust relief system which is not in communication with a wall of water but which is different than the following invention is disclosed in Miller et al. U.S. Pat. No. 3,911,852.

SUMMARY OF THE INVENTION

This invention provides a marine propulsion device comprising a propulsion unit including an internal combustion engine including an exhaust gas outlet, and a lower unit connected to the engine and including a rotatably supported propeller intended to be at least partially submerged in water, an exhaust gas discharge outlet intended to be submerged in water when the engine is operating at low speed, an exhaust gas duct extending from the engine exhaust gas outlet to the discharge outlet, an exhaust relief outlet communicating with the atmosphere, and an exhaust relief passageway extending from the engine exhaust gas outlet to the exhaust relief outlet.

One of the principal features of the invention is the provision of a water jacketed exhaust relief system which is segregated from the wall of water around the exhaust gas duct so the exhaust relief system is independent of backpressure conditions resulting from the wall of water.

Other features and advantages of the invention will become known by reference to the following drawings, general description and claims.

Figure 1:
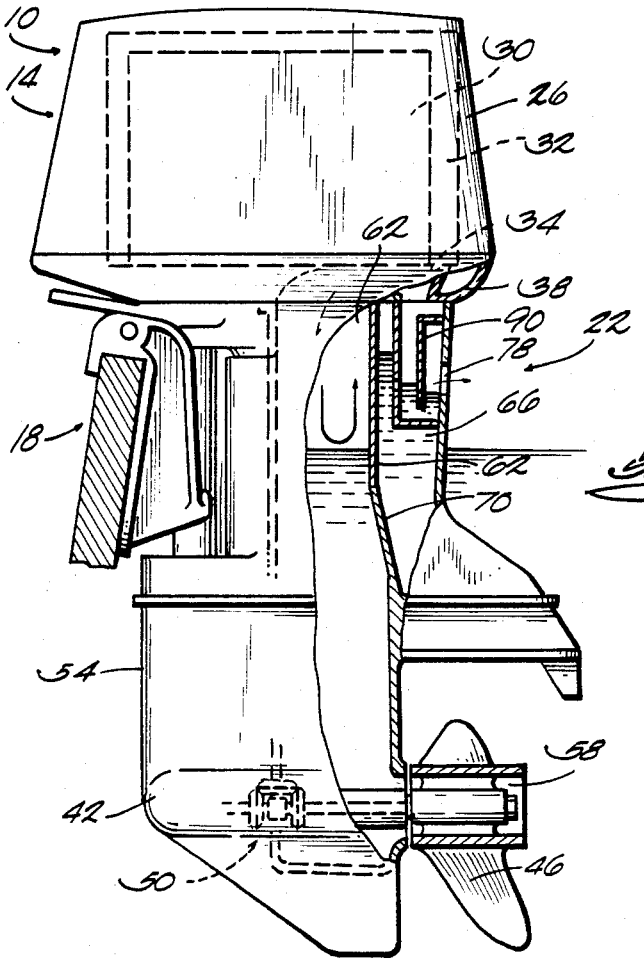
FIG. 1 is a side elevation view, partially broken away and in section of a marine propulsion device embodying various of the features of the invention.
Figure 2:
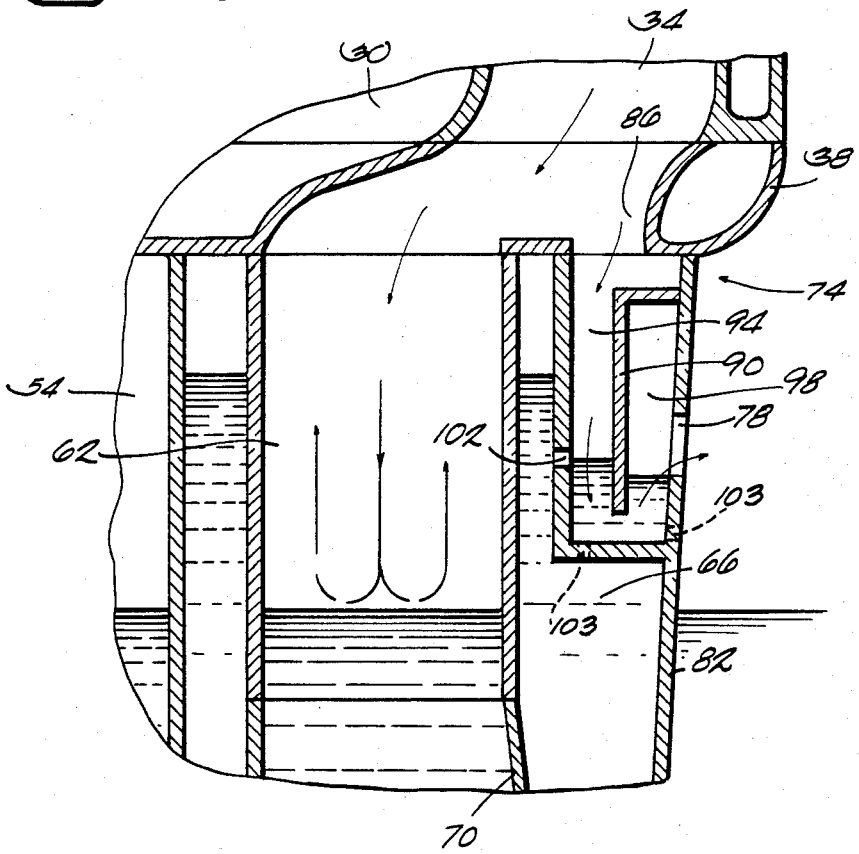
FIG. 2 is an enlarged partial side sectional view of the marine propulsion device shown in FIG. 1.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

DESCRIPTION OF THE PREFERRED EMBODIMENT

Shown in FIG. 1 of the drawings is a marine propulsion device 10 in the form of an outboard motor which includes a propulsion unit 14 and means 18 for attaching the propulsion unit 14 to the stern of a boat and for permitting horizontal swinging or steering movement and vertical tilting movement of the propulsion unit 14 relative to the boat. Any suitable attaching arrangement can be employed.

Also included in the propulsion unit 14 are a lower unit 22 and a powerhead 26. The powerhead 26 includes an internal combustion engine 30 which includes an exhaust system 32 with an exhaust gas outlet 34 on an underneath side of the engine 30. The lower unit 22 supports the powerhead 26 and includes at the upper end thereof an adapter or member 38 which is bolted or otherwise solidly connected to the engine 30. The lower unit 22 also includes a gear box 42 which supports a propeller 46 and which can include a reversing transmission 50, together with a drive shaft housing 54 which is fixed to the gear box 42 and extends upwardly therefrom to where it is fixed to the adapter 38.

Also included in the lower unit 22 is an exhaust gas discharge outlet 58 which, as illustrated, is of the through-the-propeller type. Other exhaust gas discharge outlets can also be employed. The exhaust gas discharge outlet 58 can either be underwater at all times or can be located so that it is elevated to or above the water line during high speed operation when the supporting boat rises up on a plane.

Extending in the lower unit 22 through the adapter 38 and drive shaft housing 54 between the engine exhaust gas outlet 34 and the exhaust gas discharge outlet 58 is a main exhaust gas duct 62 which, at least in part, is provided with a water jacket 66 defined by suitable wall means 70. (Water can be supplied to the water jacket from the cooling water discharged from the engine or by any other suitable means.)

While other arrangements could be employed, in the illustrated construction, the wall means 70 extends continuously upwardly to the adapter 38, and a restricted opening (now shown) is provided adjacent to the bottom of the water jacket 66 for discharge of the water into the atmosphere, or directly into the water below the normal operating water level. The water can also be discharged into the exhaust gas duct 62. The size of the restricted opening would be such, as compared to the capacity of a water pump (not shown) for filling the water jacket 66 so that, in operation, the water jacket would be substantially full whenever the engine is running. Alternately, the wall means 70 can include an overflow edge or weir which conducts overflow or discharge water for passage through a port in the outer wall of the lower unit 22, and into the atmosphere. If desired, the overflow water discharge could be ducted internally of the drive shaft housing 54 for discharge from the lower unit 22 directly into the water below the normal operating water level, or for discharge into a lower part of the exhaust gas duct 62 for mixture with the exhaust gas.

As underwater exhaust gas discharge is often blocked or prevented by the mass of the water at the exhaust gas discharge outlet 58 when the outboard motor is idling or operating at low speeds, an idle exhaust gas relief means 74 is provided. In the illustrated construction, such exhaust relief means 74 comprises an exhaust gas relief outlet or port 78 which is located in an outer wall 82 of the propulsion unit 14 and, more specifically, is located in the lower unit 22 and communicates with the atmosphere. More specifically, in the illustrated construction, the exhaust relief outlet or port 78 is located in the drive shaft housing 54.

The exhaust relief outlet 78 is in communication with the engine exhaust gas outlet 34 by means of an idle exhaust relief passageway 86. The idle exhaust relief passageway 86 extends from the engine 30 adjacent the engine exhaust gas outlet 34 and above the drive shaft housing 54 to the exhaust relief outlet 78 in the drive shaft housing 54. More particularly, the exhaust relief passageway 86 extends through the adapter 38 and the drive shaft housing 54.

The idle exhaust relief passageway 86 extends through the water jacket 66 so the water jacket 66 serves to cool the idle exhaust gases. The exhaust relief passageway 86 can also include a baffle 90 to slow the exhaust gases and lower the noise level of the exhaust gases. The baffle 90 forms an exhaust relief cavity 94 which extends down below the exhaust relief outlet 78 and assists with further reducing the noise level by providing a chamber 98 where the exhaust gases can accumulate prior to exiting through the exhaust relief outlet 78. The chamber 98 extends from and is in communication with the passageway 86 and is larger than the passageway 86 adjacent the exhaust relief outlet 78 so gases are slowed by the chamber 98 before exiting the passageway 86 through the exhaust relief outlet 78.

A small water orifice 102 permits a restricted amount of water to enter from the water jacket 66 and remain in the exhaust relief passageway 86 so the water can cool and tune the exhaust gases. Other orifices 103 can be used to drain water from the exhaust relief passageway 86 at a rate slower than the rate at which water enters orifice 102. In other embodiments, the orifices 102 and 103 can be omitted.

Various of the features of the invention are set forth in the following claims.

We claim:

1. A marine propulsion device comprising a propulsion unit including an internal combustion engine including an exhaust gas outlet, and a lower unit including a gear box, a drive shaft housing rigidly connected to and located between said gear box and said engine and including an exhaust gas relief outlet communicating with the atmosphere, a propeller rotatably supported in said gear box, an exhaust gas discharge outlet in said lower unit and intended to be submerged in water when said engine is operating at low speed, an exhaust gas duct extending from said engine exhaust gas outlet to said discharge outlet and including a portion extending downwardly in said drive shaft housing from the top thereof, and an exhaust relief passageway extending from said engine exhaust gas outlet to said exhaust relief outlet and including a portion extending downwardly in said drive shaft housing from the top thereof and in spaced relation to said portion of said exhaust gas duct in said drive shaft housing and communicating with said engine exhaust gas outlet independently of said portion of said exhaust gas duct in said drive shaft housing.

2. A marine propulsion device in accordance with claim 1 and further including a water jacket extending around a part of said portion of said exhaust relief passageway.

3. A marine propulsion device in accordance with claim 2 and further including a water jacket surrounding at least a part of said exhaust gas duct and wherein said exhaust relief passageway water jacket communicates with or forms a part of said water jacket surrounding at least a part of said exhaust gas duct.

4. A marine propulsion device in accordance with claim 2 wherein said exhaust relief passageway includes an orifice which is in communication with said water jacket surrounding said exhaust relief passageway and which permits only a limited amount of water to enter the exhaust relief passageway.

5. A marine propulsion device in accordance with claim 1 wherein said exhaust relief passageway includes a baffle.

6. A marine propulsion device in accordance with claim 5 wherein said baffle at least in part defines a chamber wherein exhaust gases can accumulate prior to exiting said exhaust relief outlet.

7. A marine propulsion device in accordance with claim 6 wherein said chamber extends from and communicates with said exhaust relief passageway.

8. A marine propulsion device in accordance with claim 1 wherein said exhaust relief outlet constitutes and aperture in said drive shaft housing.

9. A marine propulsion device in accordance with claim 1 further including an adapter connected between said engine and said lower unit and including a second portion of said exhaust gas duct and a second portion of said exhaust relief passageway.

* * * * *